US005793653A

United States Patent [19]

Segal

[11] Patent Number: 5,793,653

[45] Date of Patent: Aug. 11, 1998

[54] APPARATUS AND METHOD FOR MONITORING COMPLIANCE WITH HANDSINK USE REGIMEN

[76] Inventor: Noel B. Segal, 5809 Nicholson La., Apt. 504, Rockville, Md. 20852

[21] Appl. No.: 603,418

[22] Filed: Feb. 20, 1996

Related U.S. Application Data

[63] Continuation-in-part of Ser. No. 273,872, Jul. 12, 1994, abandoned, and Ser. No. 300,184, Sep. 2, 1994, abandoned.

[51] Int. Cl.[6] ..... G04F 5/12

[52] U.S. Cl. ..... 364/569; 364/509; 364/510; 364/550; 364/551.01; 134/57 R

[58] Field of Search ..... 364/569, 550, 364/551.01, 509, 510, 413.01–413.04; 4/623, 624, 304, 305, DIG. 3, 706, 626, 619, 628, 668; 340/573, 588, 589, 606, 618, 622, 825.3, 825.31, 825.32, 825.34, 825.35, 691; 137/624.11–624.13, 624.15, 624.21, 624.27; 222/639, 64, 52, 54, 638, 146.1, 146.2, 146.4, 146.5; 134/57 R, 58 R; 128/917, 921, 923, 924, 920

[56] References Cited

U.S. PATENT DOCUMENTS

| | | | |
|---|---|---|---|
| 3,997,873 | 12/1976 | Thornton | 340/825.31 |
| 4,606,085 | 8/1986 | Davies | 4/624 |
| 4,896,144 | 1/1990 | Bogstad | 340/691 |
| 4,942,631 | 7/1990 | Rosa | 4/623 |
| 5,016,172 | 5/1991 | Dessertine | 364/413.02 |
| 5,060,323 | 10/1991 | Shaw | 4/304 |
| 5,184,642 | 2/1993 | Powell | 4/623 |
| 5,202,666 | 4/1993 | Knippscheer | 4/623 |
| 5,265,628 | 11/1993 | Sage et al. | 134/58 R |

FOREIGN PATENT DOCUMENTS

| | | | |
|---|---|---|---|
| 9310311 | 5/1993 | WIPO | 4/623 |

*Primary Examiner*—Emanuel T. Voeltz
*Assistant Examiner*—Hal D. Wachsman
*Attorney, Agent, or Firm*—Finnegan, Henderson, Farabow, Garrett & Dunner, L.L.P.

[57] ABSTRACT

An apparatus is provided for monitoring use of a handsink to determine compliance with a use regimen by a user, the apparatus including a first data collection device for determining an identity of the user of the handsink during each use for comparison to the use regimen, a second data collection device for determining a time of use of the handsink by the user during each use for comparison to the use regimen, and a device for evaluating compliance with the use regimen by the user based on the determined identity of the user and the determined time of use. Third, fourth, and fifth data collection devices may be provided for determining a completion of use of the handsink during each use for comparison to the use regimen, the determined completion being also employed by the compliance evaluating device. A corresponding method is also disclosed, as is a system for monitoring compliance with a cleansing regimen, the system including a plurality of cleansing stations each including a monitor box, electronic communication links between the monitor boxes, and a central control device located remote from the cleansing stations and electronically connected to at least one of the monitor boxes for receiving downloaded information from the cleansing stations.

6 Claims, 6 Drawing Sheets

APPARATUS AND METHOD FOR MONITORING COMPLIANCE WITH HANDSINK USE REGIMEN

PRIOR APPLICATIONS

The present application is a continuation-in-part of U.S. application Ser. No. 08/273,872, filed Jul. 12, 1994, and U.S. application Ser. No. 08/300,184, filed Sep. 2, 1994, both of these abandoned applications are incorporated by reference herein.

BACKGROUND OF THE INVENTION

The present invention is directed to an apparatus and a method for ensuring that users of a handsink comply with a use regimen.

FIELD OF THE INVENTION

In many industries, particularly those relating to the processing and preparation of food, contamination of the product by workers is a major public health threat. Government health inspectors and industry management have therefore sought to require workers to wash their hands before handling the product and after their hands may have come into contact with any substance that could contaminate the product.

The U.S. Food and Drug Administration's Food Code provides guidelines for preparing food and preventing food-borne illness. Retail outlets such as restaurants and grocery stores and other institutions such as nursing homes are subject to the Food Code. The Food Code specifies that certain employees must periodically (e.g., every thirty minutes) follow a defined cleaning procedure (e.g., clean hands and exposed portions of arms for at least specifies that employees must follow a more rigorous cleaning procedure after using the bathroom (Food Code, § 2-301.13).

In addition to requiring employees to wash their hands, the Food Code requires their employer to monitor the employees' handwashing. For example, the Food Code requires implementation of a Hazard Analysis Critical Control Point Plan (HACCP Plan), which is to be monitored by a "person in charge." An HACCP Plan must include a method for monitoring and a frequency for monitoring and controlling each critical point, a method and a frequency to routinely verify employees are following standard operating procedures and monitoring critical control points, and a system for maintaining records to demonstrate that the HACCP Plan is properly operated and managed (Food Code, § 8-201.14).

Local, state, and federal regulators use the Food Code as a model to help develop or update their own food safety rules and to be consistent with national food regulatory policy. Also, many of the over one million retail food establishments attempt to apply Food Code provisions to their own operations, although the Food Code is neither federal law nor federal regulation and does not preempt state or local laws.

Despite such extensive efforts to ensure that proper handwashing is performed, more than a quarter of all food-borne illnesses (6,000,000 reported cases, an estimated 81,000,000 unreported cases, and 9,000 deaths in 1992) are thought to be due to improper handwashing. Similar concerns exist in the health care industry, where improper handwashing is believed to cause over 500,000 hospital-related (nosocomial) infections each year.

SUMMARY OF THE INVENTION

It is therefore an object of the present invention to provide an efficient and effective apparatus and method for monitoring compliance with a handsink use regimen by users.

In accordance with one aspect of the invention, an apparatus is provided for monitoring use of a handsink to determine compliance with a use regimen by a user. The apparatus includes a first data collection device for determining an identity of the user of the handsink during each use for comparison to the use regimen, and a second data collection device for determining a time of use of the handsink by the user during each use for comparison to the use regimen. A device is provided for evaluating compliance with the use regimen by the user based on the determined identity of the user and the determined time of use.

In accordance with another aspect of the invention, a system is provided for monitoring use of a plurality of handsinks to determine compliance with a use regimen by a user. The system includes a plurality of first data collection devices, each of the first data collection devices being disposed proximate one of the handsinks for determining an identity of the user of the handsink during each use for comparison to the use regimen, and a plurality of second data collection devices, each of the second data collection devices being disposed proximate one of the handsinks for determining a time of use of the handsink by the user during each use for comparison to the use regimen. A device is provided for evaluating compliance with the use regimen by the user based on the determined identity of the user and the determined time of use obtained from any of the first and second data collection devices.

In accordance with yet another aspect of the invention, a system is provided for monitoring compliance with a cleansing regimen by a person. The system includes a plurality of cleansing stations, each station including a handsink, an identity data collection device for determining an identity of the person using the handsink, a washing control device for providing wash supplies to the handsink in a predetermined wash sequence, a washing data collection device for determining whether the person using the handsink has completed the wash sequence, a monitor box mounted adjacent the handsink including a device for evaluating compliance with the cleansing regimen by the person based on the determined identity of the person and the wash sequence completion information. Electronic communication links are provided between the compliance evaluating devices, whereby compliance with the cleansing regimen is evaluated based on the determined identity and wash sequence completion information from all of the handsinks. A central control device is located remote from the cleansing stations and is electronically connected to at least one of the monitor boxes for receiving downloaded information from the cleansing stations.

In accordance with still another aspect of the invention, a method is provided for determining compliance with a cleansing regimen by a user of a handsink. The method includes determining for each use of the handsink an identity of the user for comparison to the cleansing regimen, determining for each use of the handsink a time of use for comparison to the cleansing regimen, and evaluating, based on the determined identity of the user and the determined time of use, compliance with the cleansing regimen by the user.

In accordance with another aspect of the invention, an apparatus is provided for monitoring use of a handsink by a user to determine whether the user has complied with a use regimen. The apparatus includes a device for determining an identity of the user of the handsink during each use, a device for determining a time of use of the handsink during each use, and a device for evaluating compliance with the use regimen by the user based on the determined identity of the user and the determined time of use.

In accordance with other aspects of the invention, the apparatus may include a third data collection device for determining a completion of use of the handsink during each use for comparison to the use regimen, the determined completion being employed by the means for evaluating compliance, or the compliance evaluating device of the apparatus, upon determining a lack of compliance with the use regimen by the user, may generate a signal to indicate the lack of compliance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

It is to be understood that both the foregoing general description and the following detailed description are exemplary and explanatory only, and are not restrictive of the invention as claimed.

BRIEF DESCRIPTION OF THE DRAWINGS

The accompanying drawings which are incorporated in and constitute a part of the specification, illustrate the presently preferred embodiments of the invention and, together with the description, serve to explain the principles of the invention.

DETAILED DESCRIPTION OF THE PREFERRED EMBODIMENTS

Figure 1:
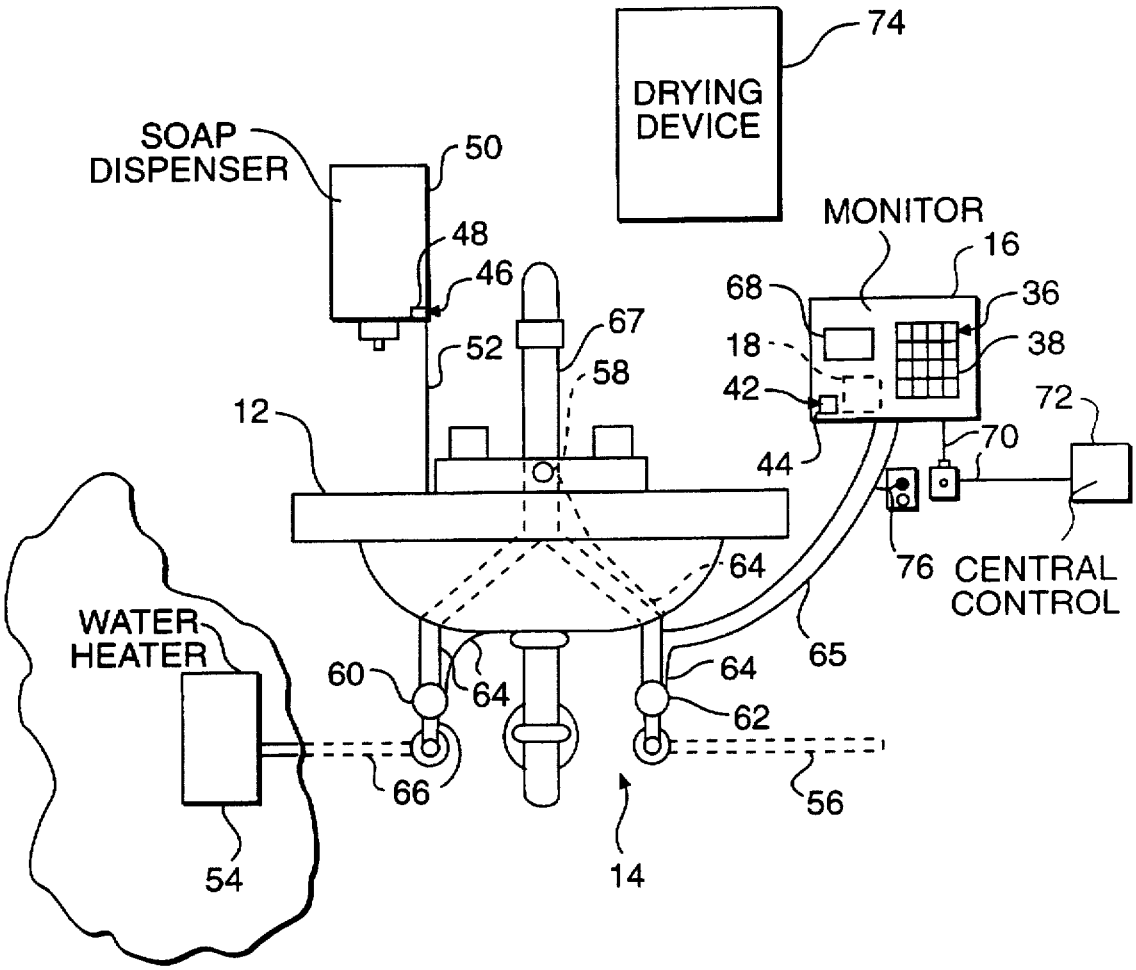
FIG. 1 is a front diagrammatical view of an apparatus according to a first embodiment of the present invention including a single handsink.

Reference will now be made in detail to the presently preferred embodiments of the invention, examples of which are illustrated in the accompanying drawings. In some instances, similar reference characters will be used in the drawings to refer to the same or like parts.

According to the present invention and as broadly embodied herein, an apparatus is provided for monitoring the use of a handsink to determine compliance with a use regimen by a user. As broadly shown in FIGS. 1 and 2, an apparatus 10 is provided for monitoring use of a handsink 12 connected to a water supply assembly 14 providing hot and cold water to the handsink. The apparatus 10 includes a monitor box 16 mounted adjacent the handsink 12. The monitor box 16 houses a controller 18, such as a general purpose computer, that controls the operation of the apparatus in response to sensed and input data.

Figure 3:
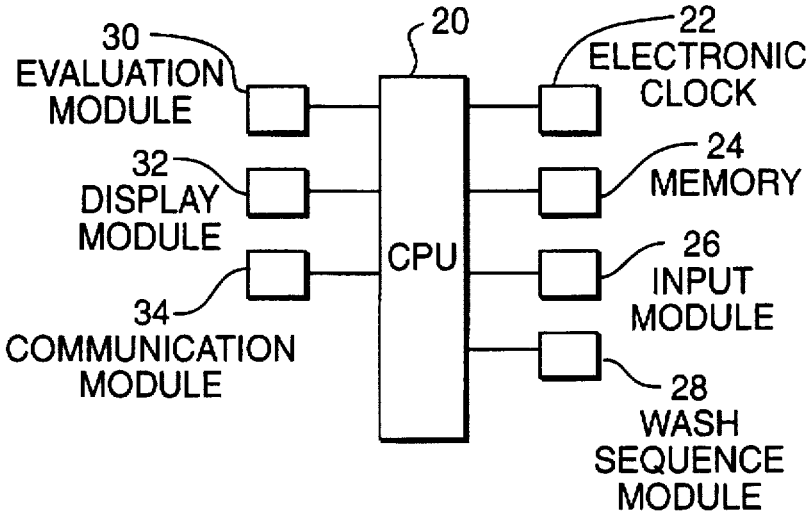
FIG. 3 is a diagram showing the interactive connections of various elements within the controller of the present invention.

As shown in FIG. 3, the controller 18 includes a central processing unit (CPU) 20, an electronic clock circuit 22, a memory 24, and a computer program, including an input module 26, a wash sequence module 28, an evaluation module 30, a display module 32, and a communication module 34. Preferably, the CPU 20 is a Motorola 68H16® controller chip. The operation of the apparatus 10, as directed by the controller 18 and its elements in response to various inputs, will be described in more detail below.

The handsink use regimen may be a cleansing regimen set forth in the FDA Food Code or any other government regulation, or may be any other specified regimen, and may have various predetermined parameters. For example, the cleansing regimen may require each user of the handsink to wash his or her hands at given intervals. Thus, the regimen may require a food service employee to wash every thirty minutes.

Alternately, the cleansing regimen may require each user of the handsink to wash his or her hands after specified events.

Thus, the regimen may require a food service user to wash after using a bathroom, or may require a healthcare professional to wash after interacting with a patient.

The cleansing regimen may also specify a wash sequence including various steps, their duration, and their sequential order, such as wetting for five seconds, soaping and scrubbing for twenty seconds, and rinsing for five seconds. If all of the steps are not completed, the wash is considered incomplete, and compliance with the regimen is not achieved.

Alternately, the cleansing regimen may require different types of washes at different times or after certain events. Thus, a more thorough wash may be required periodically or after a bathroom visit.

The present invention is capable of monitoring compliance with each of the above variations in cleansing regimen either separately or simultaneously. However, it should be understood that the present invention is not limited to monitoring only the specified regimen variations discussed herein.

Figure 2:
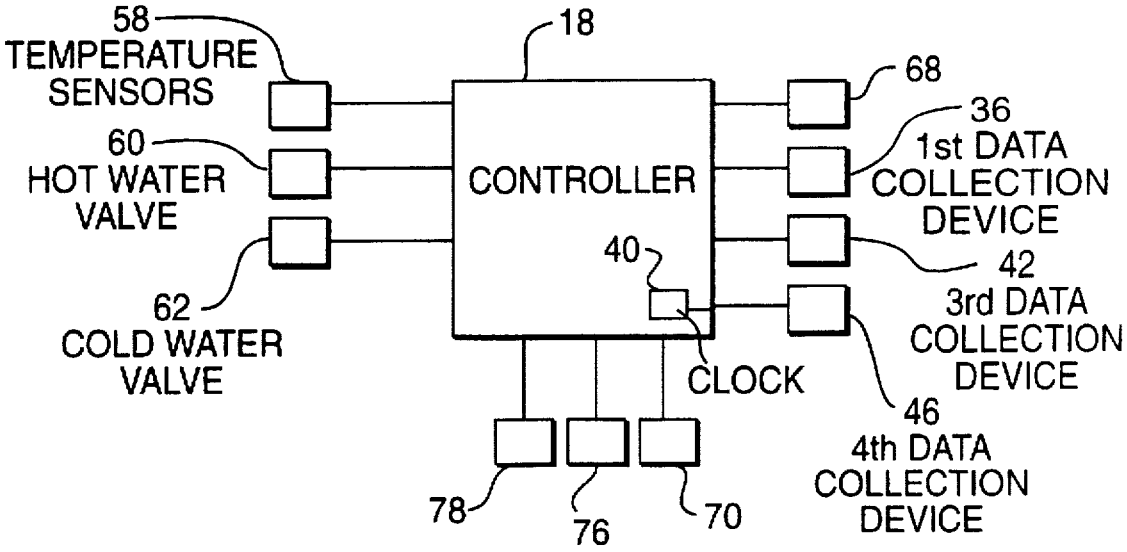
FIG. 2 is a diagram showing the interactive connections between the controller of the present invention and various inputs and outputs.

In accordance with the invention, a first data collection device is provided for determining an identity of the user of the handsink during each use for comparison to the use regimen. As shown in FIGS. 1 and 2, a first data collection device 36 is provided on the monitor box 16. Although the first data collection device 36 is shown in FIG. 1 as being mounted directly on the monitor box 16, the device 36 may be disposed anywhere near or as a component of the handsink so as to be convenient to users. The first data collection device 36 determines the identity of the user by receiving a code, specific to that particular user, each time that user uses the handsink 12.

Preferably, as shown in FIG. 1, the first data collection device 36 includes a keypad 38 to be operated by the user. The keypad 38 should be capable of receiving codes identifying the users and codes identifying wash types. Thus, the keypad 38 may be of any commonly available alphanumeric design known in the art.

Alternately, the first data collection device 36 may include barcode reader, a magnetic strip reader, or any other suitable data collection or identifying device. If a barcode reader or magnetic strip reader is used as the first data collection device 36, a card or badge containing a barcode or magnetic strip, respectively, would be issued to each user. To indicate his or her identity, the user would place the barcode or magnetic strip in front of or into the reader to allow the first data collection device to determine the identity of the user.

An advantage of using a reader is that accidental or intentional entry of the wrong code by users is reduced, if not prevented, by requiring each user to carry a card or badge to be read by the reader.

An advantage of using a keypad 38 is that it allows a user to indicate his or her presence at the handsink 12 without having to worry about keeping a card or badge handy, and without requiring the employer to stock and program cards or badges for new employees. Direct identity entry into a keypad 38 is also desirable in environments where the user's hands may become extremely dirty, possibly dirtying a card or badge and interfering with a barcode or magnetic strip reader.

Thus, different types of first data collection devices 36 may be selected within the scope of the present invention, depending on the intended environment and other factors. In its broadest sense, the present invention is not limited to use of any of the disclosed first data collection devices, and accordingly other suitable alternative devices may be employed.

Preferably, a second data collection device is provided for determining a time of use of the handsink by the user during each use for comparison to the use regimen. As broadly embodied in FIGS. 1–3, the controller 18 disposed within the monitor box 16 includes a second data collection device 40 for determining a time of use of the handsink 12. The second data collection device 40 preferably automatically determines the time of use when the user uses the handsink 12 in order to prevent accidental or intentional entry of the wrong time by the user.

As shown in FIG. 3, the preferred second data collection device 40 is the electronic clock circuit 22 of the controller 18. The electronic clock circuit 22 continuously generates a time signal during the users' working hours. Each time that the first data collection device 36 is activated by the user, the time signal generated by the electronic clock circuit 22 is stored along with the identity of the user in the memory 24 of the controller 18. Thus, when the first data collection device 36 determines the identity of the user, the second data collection device 40 determines the time of the use, and the determined identity and time are stored together in the memory 24.

Preferably, a third data collection device is provided for determining a completion of use of the handsink during each use for comparison to the use regimen. As broadly embodied in FIGS. 1 and 2, the apparatus 10 includes a third data collection device 42 for determining completion of use. As shown in FIG. 1, the third data collection device 42 is mounted on the control box 16 adjacent the handsink 12, although the device 42 could be disposed anywhere near or as a component of the handsink, so as to be convenient to the user. The third data collection device 42 preferably determines whether the user has completed use of the handsink 12 without requiring the user to make physical contact, in order to maintain cleanliness of the user's hands after cleansing.

As shown in FIG. 1, the third data collection device 42 preferably includes a photosensor 44 capable of detecting the presence of an object in its vicinity by detecting variations in ambient light. Alternately, the third data collection device 42 could be an infrared detector, or any other type of noncontacting sensor, within the scope of the present invention.

If the third data collection device is a photosensor 44, the photosensor can operate in at least two modes to determine and signal the completion of use of the handsink 12. In a first mode of operation, the photosensor 44 detects the presence of the user's hand within a few inches of the photosensor after completion of a wash sequence (i.e., after the user has soaped, scrubbed, and rinsed his or her hands) and generates a completion signal in response. Thus, after the user completes the wash sequence, the user waves his or her hand in front of the photosensor 44 to indicate completion. If the user does not indicate the completion of the wash sequence by waiving in front of the photosensor 44, the photosensor will determine that the user is not still present and will not generate a completion signal.

In a second mode of operation, the photosensor 44 detects the presence of the user's body in front of the handsink 12 and generates a completion signal in response. In this mode, the photosensor 44 can either continuously attempt to detect the presence of the user throughout the wash sequence, or it can attempt to detect the presence of the user only after completion of the wash sequence. Thus, if used in the second mode, the sensitivity of the photosensor 44 should be such that it can detect objects several feet away. In the second mode, if the photosensor 44 detects the user in front of the handsink 12, either continuously or after completion of the wash sequence, the photosensor generates a completion signal. If the photosensor 44 detects that the user is not present in front of the handsink 12, either continuously or after completion of the wash cycle, no completion signal is generated.

As an option, the apparatus may also include a fourth data collection device for detecting cleaning agent use during each use of the handsink. As broadly shown in FIGS. 1 and 2, the apparatus 10 includes a fourth data collection device 46 for detecting cleaning agent use. A shown in FIG. 1, the fourth data collection device 46 preferably includes a vibration sensor 48 attached to a cleansing agent dispenser 50 mounted near the handsink 12. If a vibration sensor 48 is used as the fourth data collection device, it may include a piezoelectric sensor for detecting low frequency resonance caused by the user's contacting the cleansing agent dispenser to obtain cleansing agent. Alternately, other contact or noncontact sensors could be substituted for the vibration sensor 48, within the scope of the present invention. As shown in FIG. 1, the fourth data collection device 46 is electronically connected to the controller 18 via wiring 52.

As a further option, an additional dispenser (not shown) and a corresponding sensor and wiring may be provided. This dispenser could dispense sanitizer (or disinfectant) to be used after final rinsing. A fifth data collection device could sense whether a user had used the sanitizer after washing, and the wash regimen could require its use. Thus, the compliance evaluating device would also use the completion data gathered from the fifth data collection device to evaluate compliance with the wash regimen.

A paper towel dispenser 74 is also shown in FIG. 1 for hand drying after cleansing. If desired, a hot-air dryer may alternatively be used. As also shown in FIG. 1, an electrical power connection 76 is provided. A battery back-up may be provided within the monitor box 16 to maintain the memory 24 in case of interruption in electrical power supply.

Preferably, the wash supply assembly supplies wash materials to the handsink in a predetermined wash sequence.

More preferably, the wash supply assembly includes a water supply for dispensing water of a predetermined temperature through a conduit to the handsink, and also includes a temperature sensor disposed in the conduit for measuring a temperature of the water prior to dispensing. Further, when the temperature sensor senses that the temperature of the water in the conduit is below the predetermined temperature, the wash supply assembly purges water from the conduit until the temperature sensor senses that the temperature of the water in the conduit has reached the predetermined temperature.

As broadly embodied in FIGS. 1 and 2, the wash supply assembly 14 includes a hot water supply 54, a cold water supply 56, a temperature sensor 58, flow control valves 60 and 62, and wiring 64 connecting the sensor 58 and valves 60 and 62 to the controller 18. The valves 60 and 62 are preferably solenoids controlled by the controller 18, and are preferably opened simultaneously during cleansing to provide mixed hot and cold water at or above the predetermined temperature. Alternately, a single solenoid could be provided downstream of the joinder of the hot and cold water supplies 54 and 56.

One or more wash sequences, as described above in connection with the cleansing regimens, may be stored in the memory 24 of the controller 18, which directs the various elements of the wash supply assembly 14 to carry out the wash sequences. For example, the controller 18 might direct the solenoids 60 and 62 to open for a period of time to wet the user's hands, direct the solenoids to close for a period of time to allow the user to scrub with a cleansing agent, and then direct the solenoids to open again for a period of time to allow the user to rinse off the cleansing agent. Closing the solenoids 60 and 62 during the scrubbing period advantageously conserves water and heating energy, as well as making the user wait to rinse, thereby likely increasing the actual scrubbing duration to the entire designated scrubbing period.

As a cleansing regimen may require that water of a predetermined (hot) temperature be provided to the user for effective cleaning, the controller 18 may direct the solenoids 60 and 62 to open periodically to purge water in the piping 66 and 67 between the hot water supply 54 and the handsink 12 that may have cooled to below the predetermined temperature. Preferably, the temperature sensor 58 detects the temperature of the water in the portion of the piping 67 downstream of where flows from the hot and cold water supplies 54 and 56 merge, and the controller 18 directs the solenoids 60 and 62 to open when the detected temperature is below the predetermined temperature. Alternately, only the hot water solenoid 60 may be opened to raise the water temperature at the temperature sensor 58, if desired. Once the temperature sensor 58 senses that the water in the piping 67 has reached or exceeded by a certain amount the predetermined temperature, the controller 18 directs the hot water solenoid or solenoids to close.

In accordance with the invention, a device is provided for evaluating compliance with the use regimen by the user based on the determined identity of the user and the determined time of use. As set forth in FIGS. 2 and 3, the compliance evaluating function is performed by the controller 18. Specifically, the CPU 20 and the evaluating module 30 of the controller 18 determine compliance with the use regimen based on the electronic clock signals generated by the electronic clock circuit 22, the cleansing regimen stored in the memory 24, and the identity of user data gathered by the first data collection device 36 and input to the input module of the controller 18.

Preferably, the compliance evaluating device employs the completion information obtained by the third, or the fourth, data collection device to determine whether the user has complied with the use regimen. As shown in FIGS. 2 and 3, the CPU 20 of the controller 18 evaluates compliance with the use regimen based on the completion information collected by the third or fourth data collection device 42 or 46 and input to the input module 26 of the controller. The CPU 20 and the evaluation module 30 determine, based on a comparison to the cleansing regimen stored in the memory 24, whether the user has complied with the cleansing regimen. Alternately, the compliance evaluating device may employ completion information from both the third and fourth data collection devices 42 and 46 to evaluate compliance with the cleansing regimen.

Preferably, the means for evaluating compliance, upon determining a lack of compliance with the use regimen by the user, generates a signal to indicate the lack of compliance. As shown in FIGS. 1 and 2, a display element 68 is provided on the monitor box 16 for providing various information to the user. For example, the display element 68 may indicate to the user the identity code entered by the user or the time of use. Also, the display element 68 may signal a complete or an incomplete wash to the user, or may instruct the user as to the steps to follow in the wash sequence as the sequence progresses.

Preferably, the display element 68 indicates, based on the determined compliance with the cleansing regimen, as described above, that the user has not complied with the regimen. Thus, the display element 68 may flash a user's identity code and a signal such as "wash due" to alert the user and others that he or she has not complied with the wash regimen.

The display element may be a LCD display, and LED display, or any other suitable display. The CPU 20 and the display module 32 of the controller 18 direct the display element 68 to display information, based on various determinations made by the elements of the controller, as described above.

Preferably, the apparatus also includes central control device located distant from the handsink and an electronic communication link between the compliance evaluating device and the central control device, the CPU directing the memory to periodically download stored data to the central control device. As shown in FIG. 1, a communication link 70 allows the controller 18 in the monitor box 16 to communicate to a central control device 72, which is a general purpose computer that can be located remote from the handsink. Periodically, the communication module 34 in the controller 18 can download the data stored in the memory 24 to the central control device 72. A download period may be, for example, a day, a week, a month, etc. Communication via the communication link 70 may be initiated either automatically, according to download period expiration, or manually, when desired, via either the central control device 72 or the CPU 20.

The central control device 72 can include a data processor, and all of the data gathered by the first through fourth data collection devices and all of the determinations made by the CPU, can be analyzed by the central control device 72. Based on the analysis, reports can be prepared listing users, userids, and corresponding wash frequency, type, and completion information. Preparation of the reports at the remote central control device location allows the information to be obtained without requiring maintenance of a printer or the like at the handsink location.

The communication link 70 may be any of a number of suitable communication devices. For example, the communication link 70 most preferably includes a telephone line, with a modem being housed in the monitor box 16 to allow communication with the central control unit 72. Alternately, the communication link 70 may include an internet connection, a local area network or a wide area network, dedicated hardwired link, or a wireless system such as radio frequency telemetry.

Alternately, the communication link 70 may be omitted if, for example, the monitor box 16 were to download data via a printer connection to printer for printing a hard copy of the data, or if data were stored on a disk, CD, or any other type of permanent media so that the data could be used by the central control unit. 72 in the ways described above.

If desired, the central control unit 72 itself may also be omitted, and the sensed and compiled data may be manipulated by the controller 18 in the monitor box 16. Alternately, if desired, the remote central control unit 72 may be replaced by a local general purpose computer equipped to communicate with the monitor box 16.

Figure 4:
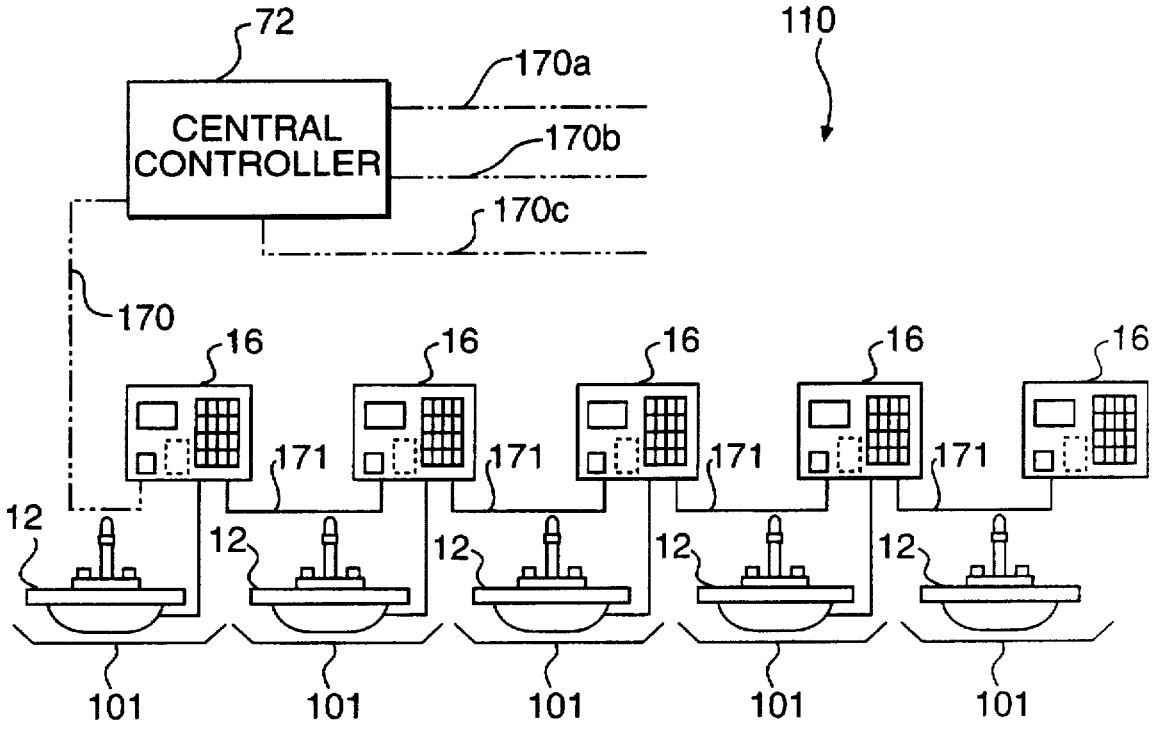
FIG. 4 is a diagrammatical view showing an apparatus according to a second embodiment of the present invention including multiple handsinks.
Figure 5:
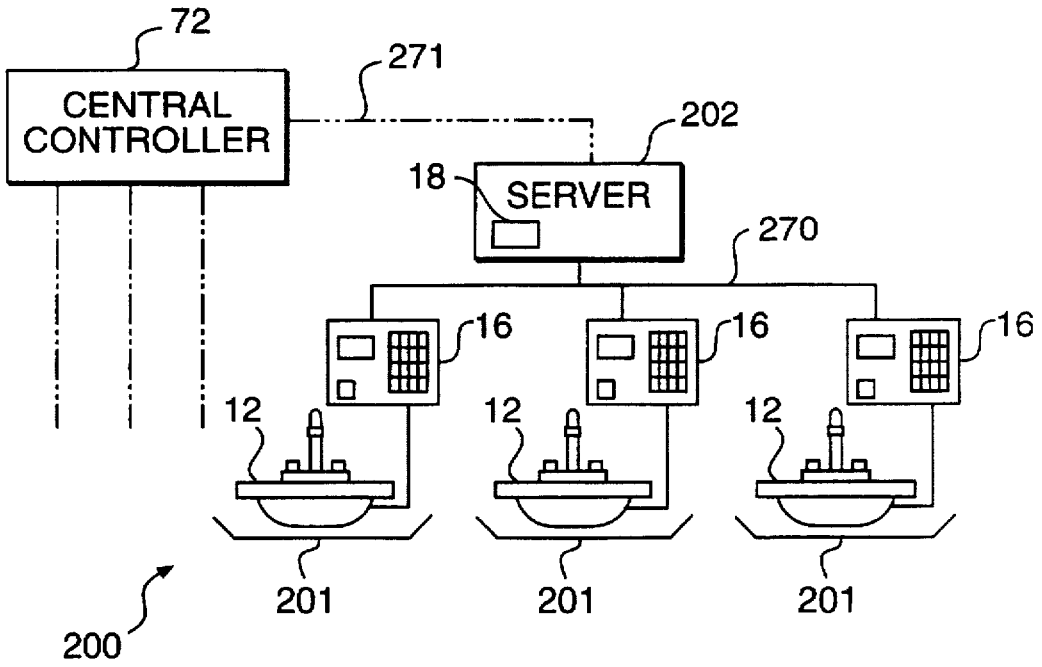
FIG. 5 is a diagrammatical view showing an apparatus according to a third embodiment of the present invention including multiple handsinks.

FIGS. 4 and 5 show alternate embodiments of the present invention in which a plurality of washing stations, each including a handsink, a monitor box, and a water supply assembly are provided. As shown in FIG. 4, an apparatus 110 is provided having five cleansing stations 101, each including a handsink 12 and a monitor box 16, as described above. Each cleansing station 101 preferably includes the first through fourth data collection devices 36, 40, 42, and 46, as described above. As shown in FIG. 4, at least one of the cleansing stations 101 is electronically connected via a communication link 170 to a central control device 72, and all of the cleansing stations are connected to each other via wiring 171. Alternately, each of the cleansing stations 101 could be connected to the central control device 72 via separate communication links. As shown in FIG. 4, the central control device 72 may be connected to other groups of cleansing stations (not shown) by other communication links 170*a–c*.

In the device of FIG. 4, the controller of the leftmost cleansing station receives and evaluates data from the first through fourth data collection devices of all of the cleansing stations via wiring 171 and determines whether the user has complied with the wash regimen. The arrangement of FIG. 4 allows a user that works in a location having a plurality of cleansing stations to use different cleansing stations over time without having false "wash due" signals being displayed on any of the wash stations not being used.

FIG. 5 shows an alternate apparatus 210 in which a plurality of cleansing stations 201 are electrically connected by a communication link 270 to a server 202, which is in turn electrically connected by another communication link 271 to a central control device 72, as described above. The server 202 houses the controller 18, so that the data gathering and evaluation is performed in the server, rather than in one of the individual monitor boxes 16. Otherwise, the arrangement of FIG. 5 operates substantially similar to that of FIG. 4.

In accordance with the present invention, a method for determining compliance with a cleansing regimen by a user of a handsink is also provided. The method comprises the steps of determining for each use of the handsink an identity of the user for comparison to the cleansing regimen, determining for each use of the handsink a time of use for comparison to the cleansing regimen, and evaluating, based on the determined identity of the user and the determined time of use, compliance with the cleansing regimen by the user. Preferably, the method includes the further steps of determining for each use of the handsink a completion of the use, and evaluating compliance with the cleansing regimen based on the determined completion, and the step of signaling the user if the step of evaluating compliance with the cleansing regimen indicates a lack of compliance by the user.

Figure 6:
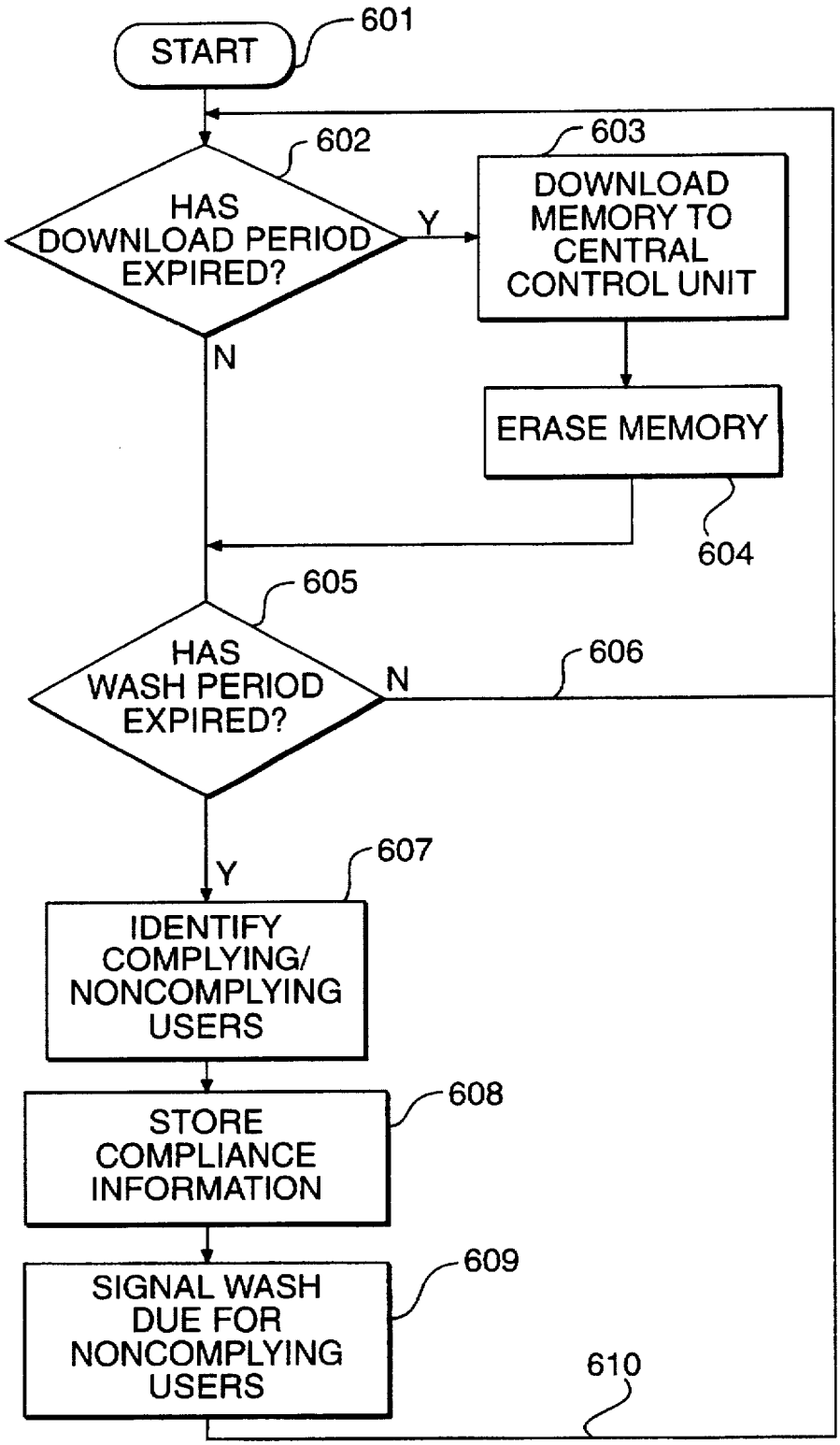
FIG. 6 is a flow chart showing operations of the present invention that occur at regular intervals according to download and wash period passage.
Figure 7:
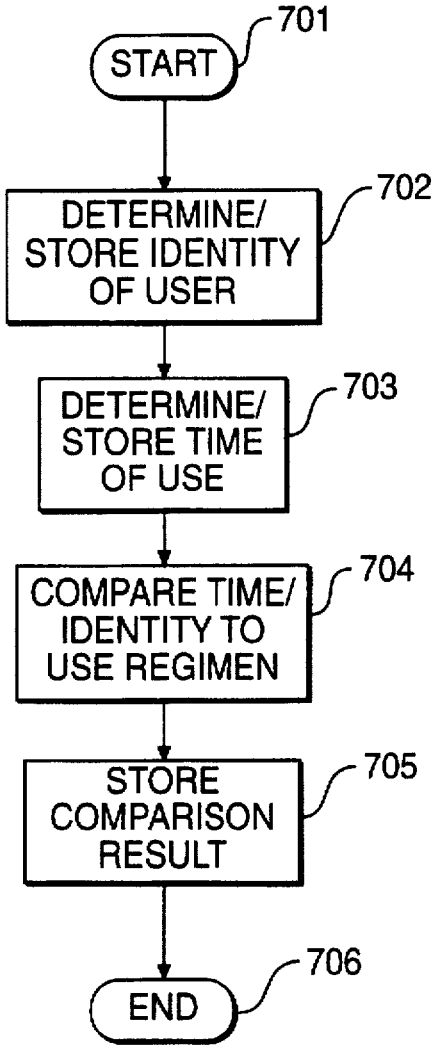
FIG. 7 is a flow chart showing operations of the present invention in response to data collected by the first and second data collection devices.
Figure 8:
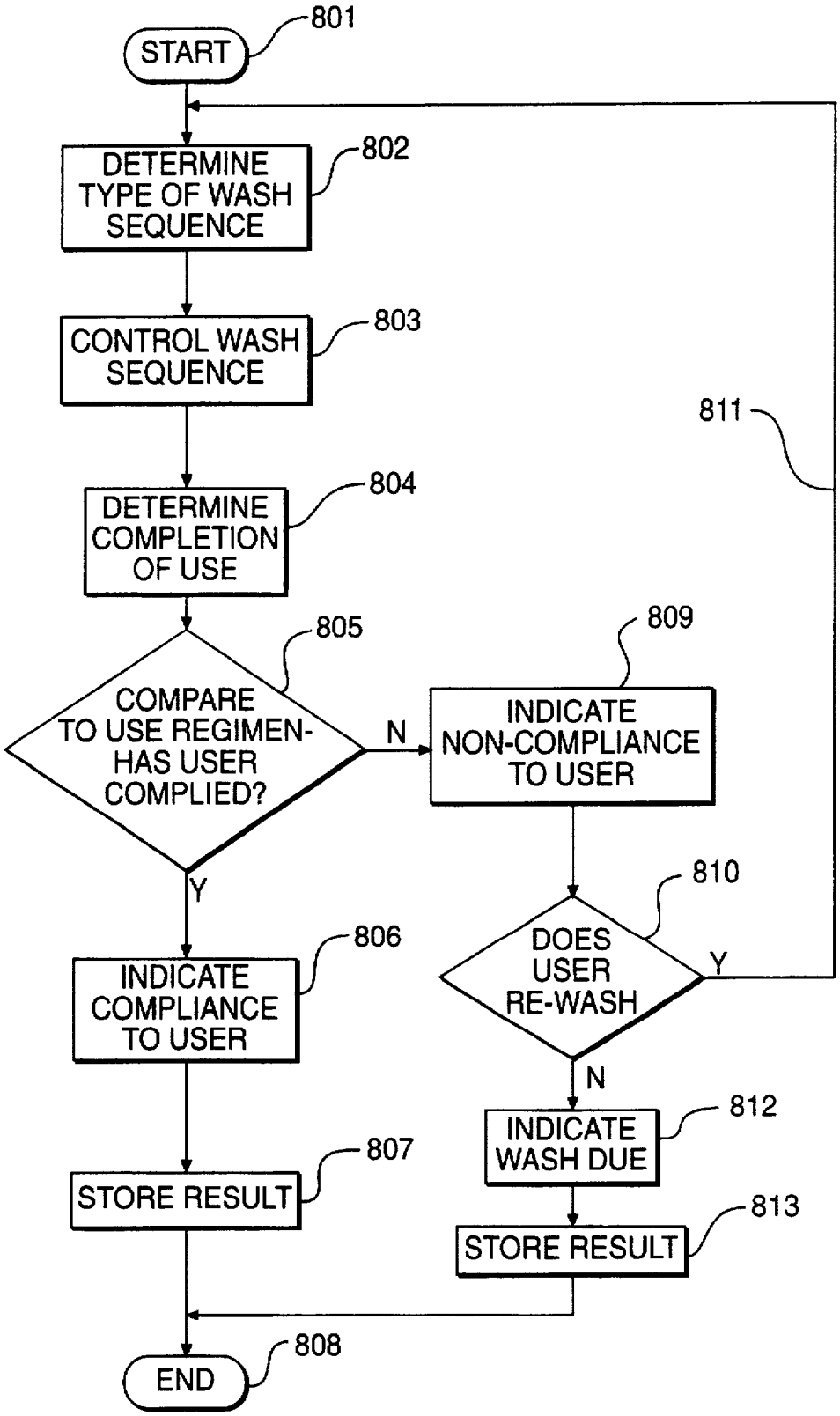
FIG. 8 is a flow chart showing operations of the present invention in response to data collected by the third and fourth data collection devices.

FIGS. 6–8 are flowcharts that further illustrate the operation of the present invention. FIG. 6 shows how the controller controls the downloading of information to the central control device and determines whether to generate wash due signals. Beginning at the "start" (601), assuming that a central control device 72 is employed, the CPU 20 and the evaluation module 30 determine (602) whether the download period has expired with reference to the electronic clock circuit 22. If the download period has expired (603), the CPU 20 and the communication module 34 download the memory 24 via the communication link 70 to the central control device 72. The CPU 20 then causes the memory 22 to be erased (604).

If the download period has not expired, or after the memory is erased, the CPU 20 and the evaluation module 30 determine (605) whether the wash period (a maximum permissible period between washes dictated by a wash regimen) has expired with reference to the electronic clock circuit 22. If not, the analysis begins again (606).

If the wash period has expired, the CPU 20, evaluation module 30, electronic clock circuit 22, and input module 26 identify complying and noncomplying users (607). The CPU 20 then directs the memory 24 to store the compliance information (608). The CPU 20 and the display module 32 then cause the display element 68 to indicate that noncomplying users have not complied with the cleansing regimen (609). At this point, the analysis begins again (610).

FIG. 7 shows the evaluation of compliance with the cleansing regimen based on determined user identity and time data. Beginning at the "start" (701), the first data collection device 36 determines the identity of the user, which the CPU 20 and input module 26 direct to be stored in the memory 24 (702). The second data collection device 40 determines the time of the use, which the CPU 20 and input module 26 direct to be also stored in the memory 24 (703). The CPU 20 and the evaluation module 30 then compare the identity and time data to the requirements of the cleansing regimen stored in the memory 24 (704). The CPU 20 directs that the result of the comparison be stored in the memory 24 (705), which ends (706) the analysis.

FIG. 8 shows the evaluation of compliance with the cleansing regimen based on determined completion of use data. Beginning at the "start" (801), the wash sequence is chosen from the memory 24 by the CPU 20 based on inputs from the user into the first data collection device 36 or based on a clock signal output by the electronic clock circuit 22 (802). The CPU 20 and the wash sequence module 28 then direct the water supply assembly 14 to provide cleansing supplies in the chosen wash sequence (803). The third and/or the fourth data collection devices 42, 46 then determine a completion of the use by the user (804). The CPU 20 and the evaluation module 30 then compare the completion of use data to the requirements of the cleansing regimen stored in the memory 24 (805).

If the user has complied, the CPU 20 and the display module 26 direct the display element 68 to indicate the compliance to the user (806). The CPU 20 directs that the result of the comparison be stored in the memory 24 (807), which ends (808) the analysis.

If the user has not complied, the CPU 20 and the display module 26 direct the display element 68 to indicate the lack of compliance to the user (809). The CPU 20 then determines whether the user initiates a rewashing (810). If the user does initiate a rewashing, the wash analysis begins again (811). If the user does not initiate a rewashing, the CPU 20 and the display module 26 direct the display element 68 to indicate the lack of compliance with the cleansing regimen to the user (812). The CPU 20 then directs that the result of the comparison to be stored in the memory 24 (813), which also ends (808) the analysis.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims and their equivalents.

What is claimed is:

1. A system for monitoring usage of a plurality of handsinks by users, the system comprising:

a plurality of monitoring units respectively located in proximity to the plurality of handsinks and electrically interconnected by wiring, each of the monitoring units including:

a first input device accommodating entry of user ID data by a user, a second input device for generating time of use data, a third input device for generating a soap signal upon user actuation of a soap dispenser, a fourth input device coupled to the first, second, and third input devices for generating a wash completion signal in response to a signal produced by the user, the user ID data, the time of use data, the soap signal and the wash completion signal comprising a user compliance data set, a display, and a controller coupled to the fourth input device and the display;

one of the monitor units further including:

a memory for storing the user compliance data sets generated by the first through fourth inputs devices of the one monitor unit and the user compliance data sets generated by the first through fourth input devices of others of the monitor units transmitted by the controllers thereof over the wiring, and a CPU programmed to compare each of the user compliance data sets with a cleansing regimen assigned to each handsink user and stored in the memory and to generate compliance/non-compliance data based on each comparison result for storage in the memory and for presentation to the users by the displays of appropriate ones of the monitor units; and a central unit connected over a communications link to receive periodic downloadings of the user compliance data sets and the compliance/non-compliance data from the memory of the one monitor unit.

2. The system defined in claim 1, wherein each monitor unit further includes:

a first flow control valve included in a hot water line and electrically connected to the controller;

a second flow control valve included in a cold water line and electrically connected to the controller; and a water spout connected to the hot and cold water lines by a mixing union downstream from the first and second flow control valves;

wherein the controller controls the first and second flow control valves to produce a mixed flow of hot and cold through the water spout to the user's hands according to a wash sequence determined by the user-assigned cleansing regimen stored in the memory.

3. The system defined in claim 2, wherein each monitor unit further includes a thermostat positioned downstream from the mixing union and electrically connected to input signals indicative of water temperature to the controller, the controller further controlling the first and second flow control values in response to the water temperature signals to maintain a predetermined water temperature in preparation for each wash sequence.

4. A system for monitoring usage of a plurality of handsinks by users, the system comprising:

a plurality of monitoring units respectively located in proximity to the plurality of handsinks, each of the monitoring units including:

a first input device accommodating entry of user ID data by a user, a second input device for generating time of use data, a third input device for generating a soap signal upon user actuation of a soap dispenser, a fourth input device coupled to the first, second, and third input devices for generating a wash completion signal in response to a signal produced by the user, the user ID data, the time of use data, the soap signal and the wash completion signal comprising a user compliance data set, a display, and a controller coupled to the fourth input device and the display;

a server connected in parallel to each of the monitor units over first communications links, the server including:

a memory for storing the user compliance data sets generated by the first through fourth input devices of each of the monitor units transmitted by the controllers thereof over the first communications links and a CPU programmed to compare each of the user compliance data sets with a cleansing regimen assigned to each handsink user and stored in the memory and to generate compliance/non-compliance data based on each comparison result for storage in the memory and for presentation to the users by the displays of appropriate ones of the monitor units; and a central unit connected to the server over a second communications link to receive periodic downloadings of the user compliance data sets and the compliance/non-compliance data from the memory of the server.

5. The system defined in claim 4, wherein each monitor unit further includes:

a first flow control valve included in a hot water line and electrically connected to the controller;

a second flow control valve included in a cold water line and electrically connected to the controller; and a water spout connected to the hot and cold water lines by a mixing union downstream from the first and second flow control valves;

wherein the controller controls the first and second flow control valves to produce a mixed flow of hot and cold through the water spout to the user's hands according to a wash sequence determined by the user-assigned cleansing regimen stored in the memory.

6. The system defined in claim 5, wherein each monitor unit further comprises a thermostat positioned downstream from the mixing union and electrically connected to input signals indicative of water temperature to the controller, the controller further controlling the first and second flow control values in response to the water temperature signals to maintain a predetermined water temperature in preparation for each wash sequence.

* * * * *